United States Patent [19]

Stahlecker

[11] Patent Number: 4,567,722

[45] Date of Patent: Feb. 4, 1986

[54] FIBER FEED ARRANGEMENT FOR OPEN-END FRICTION SPINNING MACHINES

[75] Inventor: Fritz Stahlecker, Bad Überkingen, Fed. Rep. of Germany

[73] Assignee: Fritz and Hans Stahlecker, Fed. Rep. of Germany

[21] Appl. No.: 647,236

[22] Filed: Sep. 4, 1984

[30] Foreign Application Priority Data

Sep. 28, 1983 [DE] Fed. Rep. of Germany ..... 3335065

[51] Int. Cl.[4] ..... D01H 7/882; D01H 7/892

[52] U.S. Cl. ..... 57/401; 57/409; 57/413

[58] Field of Search ..... 57/401, 408, 409, 411, 57/413

[56] References Cited

U.S. PATENT DOCUMENTS

| | | | |
|---|---|---|---|
| 4,050,228 | 9/1977 | Landwehrkamp et al. | 57/409 X |
| 4,315,398 | 2/1982 | Parker et al. | 57/401 |
| 4,380,892 | 4/1983 | Parker et al. | 57/301 X |

*Primary Examiner*—John Petrakes

*Attorney, Agent, or Firm*—Barnes & Thornburg

[57] ABSTRACT

A fiber feed arrangement for an open-end friction spinning machines is disclosed. The fiber distribution zone in the wedge-shaped yarn forming gap formed by the friction rollers is configured in its size and/or its location relative to the friction rollers in dependence on the fiber length being processed and/or the desired yarn characteristic. In preferred embodiments the distribution zone is adjustable by means of at least one separate movable feed channel component in the area of the feed channel opening to the friction rollers.

17 Claims, 7 Drawing Figures

FIBER FEED ARRANGEMENT FOR OPEN-END FRICTION SPINNING MACHINES

BACKGROUND AND SUMMARY OF THE INVENTION

The invention relates to an arrangement for open-end friction spinning with two adjacently arranged rollers driven in the same rotational direction and forming a yarn forming wedge-shaped gap serving as a yarn formation region. At least one fiber inlet device is provided for guiding the single fibers to the wedge-shaped gap, which fiber inlet device includes a fiber feed channel directed toward the friction rollers and fiber feed opening means forming a distribution zone for the fibers being supplied. A yarn withdrawal device is provided for drawing off the produced yarn in the longitudinal direction of the wedge-shaped gap.

With a known arrangement or device of the above-mentioned kind disclosed in German Published Unexamined Application, (DE-OS) 29 43 063, an additional channel connects to the fiber feed channel in the area of its opening. Air is sucked off through the additional channel so that the opening of the fiber feed channel and thereby also the distribution zone for the fibers to be supplied, extends practically over the entire length of the wedge-shaped gap.

With another known arrangement or device disclosed in German Published Unexamined Application (DE-OS) 30 47 987, single fibers, so called wrapping fibers, are supplied from the fiber inlet device to the wedge-shaped gap formed by the two rollers whereby the same covers a fiber rove supplied in longitudinal direction of the wedge-shaped gap. The yarn being produced is drawn off in the longitudinal direction of the wedge-shaped gap by means of a pair of withrawal rollers. The actual yarn formation process is conducted in the area of the opening of the fiber feed channel, which means the so-called dispersion or distribution zone, in which the yarn being produced gradually increases its diameter. With the known arrangement a treatment zone connects to the distribution zone in the direction of the yarn withdrawal in which, for example, a straightening of the produced yarn is contemplated.

The invention is based upon the problem to so construct an arrangement or device of the kind mentioned above, that the yarn formation process is more controlled while an adjustment can be made to accommodate the differences in the fiber material to be processed and the predetermined desired yarn characteristics.

This problem is thereby solved in accordance with the invention by establishing the relative position of the distribution zone with respect to the rollers and/or its size dependent upon the length of the fibers of the fiber material to be processed and/or dependent upon the predetermined yarn characteristics of the yarn to be produced.

The invention utilizes the determination that especially the length of the distribution zone in the longitudinal direction of the wedge-shaped gap has an important influence upon the resultant yarn formation. In this area or region a thin extending yarn tip is first formed which enlarges itself in the yarn withdrawal direction to a yarn exhibiting the final yarn thickness. The length of the yarn tip is proportional to the length of the distribution zone. With a longer distribution zone one will obtain a lesser yarn volume since the core of the yarn is spun harder or tighter while the exterior fibers forming the yarn cover are less tightly twisted. If, however, the yarn tip gets too long based upon an extensive distribution zone, the danger of decoupling exists, which means stronger twisted thinning portions which are essentially produced by false drawing. A shorter dispersion zone leads to a greater yarn volume since the core of the yarn is twisted less tightly. With a yarn tip too short due to a too short distribution zone, however, the danger exists that short periodic inconsistency errors are the result and that the fibers are less well organized and arranged. By means of testing, one can determine the most favorable length of the fiber distribution zone dependent upon the desired yarn number, the yarn characteristic, and the fiber length of the material to be spun.

According to a further aspect of the invention, means are provided by which the relative positioning of the distribution zone with respect to the roller and/or its size is adjustable. It can therefore be provided to design these means at the spinning unit of an open-end friction spinning machine. It is, however, also contemplated by the invention to produce a test spinning sample with fiber material being produced on only a single unit, for example, a spin tester, in order to thereby optimize the relative positoning of the distribution zone and/or its size. Thereafter the machine is then equipped with correspondingly dimensioned fiber feed channels or partial sections of the same channels.

According to a further aspect of certain preferred embodiments of the invention it is provided that at least the part of the fiber feed channel opposite the friction rollers is designed as an independent, interchangeable structural element. An adjustment is thereby made possible without bothering the servicing person with adjustment tasks.

According to a further aspect of certain preferred embodiments of the invention it is provided that the fiber feed channel includes a seat for an insert which contains at least one channel wall and extends up to the fiber feed opening of the fiber feed channel. Especially if the insert comprises several channel walls, according to certain preferred embodiments the fiber transport guide path within the fiber feed channel can also be influenced by exchanging the insert, whereby the spinning quality is additionally increased.

According to certain embodiments of the invention it is provided that the part of the fiber feed channel containing the fiber feed opening is limited in longitudinal direction with respect to the wedge-shaped gap by means of an adjustable channel wall. With this embodiment very accurate adjustments can be made.

In a further embodiment of the invention it is provided that the fiber feed channel essentially arranged in the plane of the wedge-shaped gap and inclined in an angle thereto is provided with a section adjustably retained in its longitudinal direction and comprising the corresponding fiber feed openings to the friction rollers. The distance of the fiber feed opening to the wedge-shaped gap or the rollers is changed by adjusting the adjustable partial element, thereby changing the position of the distribution zone, and certainly also the length of the adjacent yarn treating zone. Additionally the subpressure of the suction device effective in the fiber feed channel is thereby also influenced so that the fiber tranpsort itself has an influence upon the fiber dispersion within the fiber feed channel.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
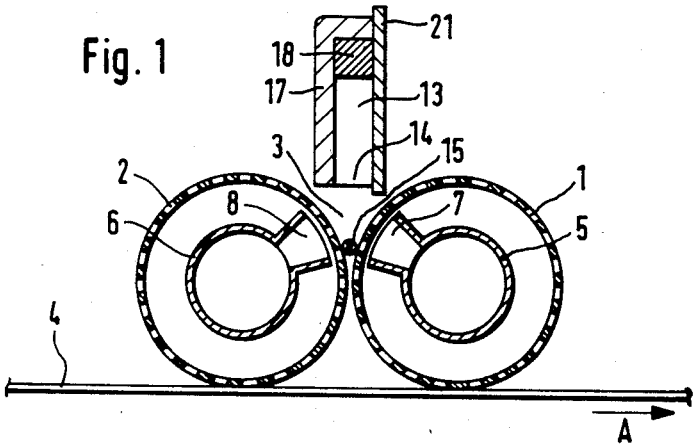
FIG. 1 is a schematic partial sectional view through the friction rollers and corresponding fiber feed channel of an arrangement for open end friction spinning constructed in accordance with preferred embodiments of the present invention.

In order not to obscure the invention, in the drawings and in the following description only those portions of an open end friction spinning machine are shown and described as are deemed necesary for one skilled in the art to understand the present invention.

Figure 2:
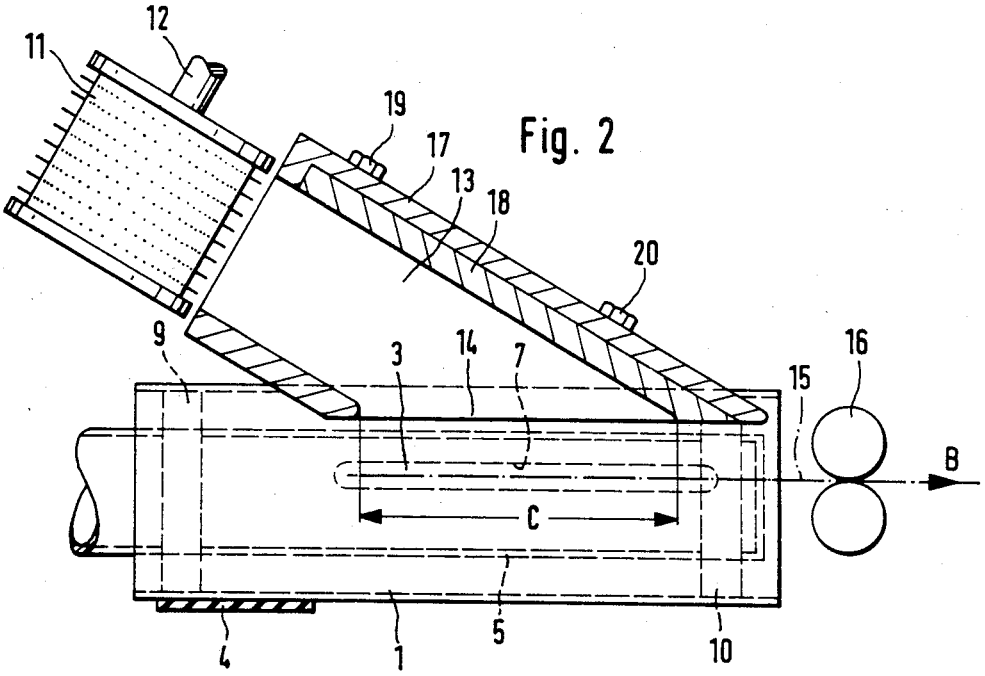
FIG. 2 is a schematic sectional view taken approximately in the plane of the wedge-shaped yarn forming gap formed by the two rollers of FIG. 1.

The arrangement for open end friction spinning shown in FIGS. 1 and 2 includes two parallel, adjacently arranged rollers 1 and 2 which together form a wedge-shaped gap 3 in which a yarn 15 is formed. Rollers 1 and 2 are driven in the same rotational direction by a tangential belt 4 which runs in arrow direction A against the cover surfaces of rollers 1 and 2. The tangential belt 4 advantgeously also drives the rollers of the adjacent spinning units on one machine side, which rollers are not illustrated here. It should be understood that especially preferred practical embodiments include a plurality of similar spinning units which have common drive means such as the tangential belt 4. The cover surface of rollers 1 and 2 are perforated along at least a portion of their length forming the yarn forming gap. Embodiments are also contemplated wherein only one of the two rollers is provided with such perforation, preferably the roller rotating into the wedge-shaped gap 3.

The interior of the rollers 1 and 2 contain suction pipes 5 and 6 which are closed at one end and are connected at their other ends protruding out of the cover surface sections of the rollers 1 and 2 to a sub-pressure source not further illustrated here. The suction pipes 5 and 6 are provided in the area of wedge-shaped gap 3 with suction slits 7 and 8 which are directed towards the wedge-shaped gap 3. Through both the suction pipes 5 and 6 and the suction slits 7 and 8, an airstream is sucked which is suppled, at least partially, via a fiber feed channel 13. The airstream facilitates supply of the fibers through the feed channel 13 and the holding of the yarn 15 being produced in the wedge-shaped gap 3. The coatings or cover surfaces of rollers 1 and 2 are borne directly upon suction pipes 5 and 6 by means of roller bearings 9 and 10.

An inlet and opening device supplies the single fibers to the wedge-shaped gap 3, only an opening roller 11 (FIG. 2) of this device being shown. The axle 12 of opening roller 11 which extends parallel to the plane of the wedge-shaped gap 3, which means the plane extending through the wedge-shaped gap 3 tranversely to the plane containing the axes of rollers 1 and 2. A fiber band or sliver is supplied to the opening roller 11 in a not further illustrated manner especially by means of a feeding device including a feeding roller and a feeding table of the type commonly known with open-end rotor spinning. A fiber feed channel 13 connects to the circumference of the opening roller 11 and extends essentially in the plane of the wedge-shaped gap 3 and inclines at an angle of about 45 degrees with respect to the longitudinal extension of the wedge-shaped gap 3.

The fiber feed channel 13 exhibits a flat, essentially square cross-section and is disposed with a fiber feed opening 14 closely opposite the wedge-shaped gap 3. The supplied single fibers are twisted to a yarn 15 which is drawn off in the longitudinal direction of the wedge-shaped gap 3 in arrow direction B by a yarn withdrawal device including a pair of draw-off rollers 16. Subsequently, the yarn 15 runs to a not further illustrated winding device and is wound upon a spool.

The fiber feed or mouth 14 of the fiber feed channel 13 forms a fiber dispersion or distribution zone extending in the longitudinal direction of the wedge-shaped gap 3, within which zone the single fibers are supplied to the wedge-shaped gap 3. The yarn is produced within this distribution zone in the form of a tip narrowing at the end opposite the withdrawal direction B whereby the yarn reaches its final thickness at the end of the distribution zone. The yarn then continues into a treatment zone to the end of the rollers 1 and 2 in which the appearance of yarn 15 is further influenced. The length of the distribution zone (Zone C) in the longitudinal direction of the wedge-shaped gap is chosen dependent upon the fiber length of the fiber material to be processed as well as upon the desired yarn number and the desired yarn characteristics. If the distribution zone C in the longitudinal direction of the wedge-shaped gap 3 is chosen relatively short, a correspondingly short yarn tip will be the result. The fibers forming the core or center of the yarn 15 being produced are then twisted less strongly, as would be the case with a longer yarn tip, so that the result is a relatively thick yarn 15. The fibers of said yarn 15 forming the coat or outer mantle are thereby twisted stronger especially if the shortening of the dispersion zone connects to an extension of the subsequent treatment zone. With the embodiment according to FIGS. 1 and 2 this change of length of the dispersion zone is determined by an insert 18 which is set into a housing 17 containing the fiber feed channel 13, and forms the channel wall restraining the fiber feed channel in the longitudinal direction of the wedge-shaped gap 3.

As can be seen from FIG. 1, housing 17 is closed by a cover 21 which forms one of the two side channel walls extending parallel to the axes of rollers 1 and 2. With the embodiment described herein the inner wall of the insert 18 extends parallel to the opposite channel wall, which insert is detachably fixedly attached to the housing 17 by means of screws 19 and 20. If the dispersion zone is enlarged or decreased in length a thicker or thinner insert 18 other than with the described embodiment, is inserted respectively. It is also contemplated by the invention to assign insert 18 an inner wall limiting the fiber feed channel 13 which wall does not extend parallel to the opposite inner channel wall. An insert 18 is advantageously provided exhibiting a cross section with a V-shaped configuration which effects a narrowing of the channel cross section in the area between the opening roller 11 and the mouth or opening 14.

Figure 3:
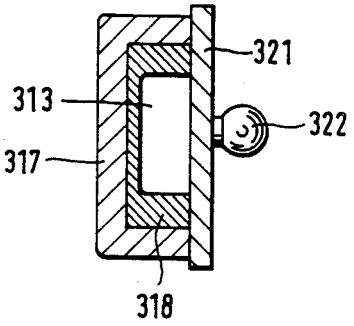
FIG. 3 is a cross-sectional view through a fiber feed channel with an insert adjustable in its cross-section according to a preferred embodiment of the invention.
Figure 4:
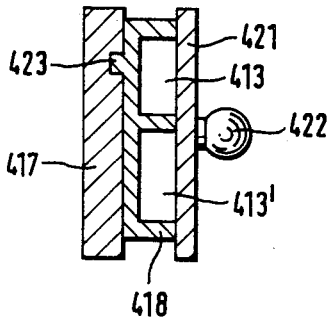
FIG. 4 is a cross-sectional schematic view through a fiber feed channel similar to FIG. 3 showing another preferred embodiment of the invention.

With the embodiment according to FIG. 3, a C-shaped channel housing 317 is provided which contains an insert 318 in its cross section which is also C-shaped, forming the actual fiber feed channel 313. The channel housing 317 and the insert 318 are connected, held by a not further illustrated lock and closed by a cover 321 having a handle 322. The insert 318 forms three side walls of the fiber feed channel 313 so that not only the length but also the width of the dispersion zone is changed for adjusting to the desired conditions. The fiber feed channel 313 is arranged corresponding to the fiber feed channel 13 of FIGS. 1 and 2, which means it exhibits a flat, square cross-section approximately in the plane of the wedge-shaped gap and connects this gap with an opening roller 11. With the embodiment according to FIG. 4 a plate-shaped channel housing 417 is provided to which an insert 418 is attached which is divided into two essentially parallel and adjacent channel sections 413 and 413' connecting an opening roller 11 with the corresponding wedge-shaped gap 3. Both the channel section 413 and 413' also extend essentially in the plane of the wedge-shaped gap 3. The two sections 413 and 413' are closed by a cover removable via a handle bar or lever 422. A forced separation, independent from the air distribution, of the fiber supply flow occurs by means of the two channel sections 413 and 413' so that it results in two sequential distribution zones which could essentially also overlap. The insert 418 is centered with a catch 423 in a corresponding recess of the plate-shaped channel housing 417, so that even after an exchange an exact adjustment is maintained.

Figure 5:
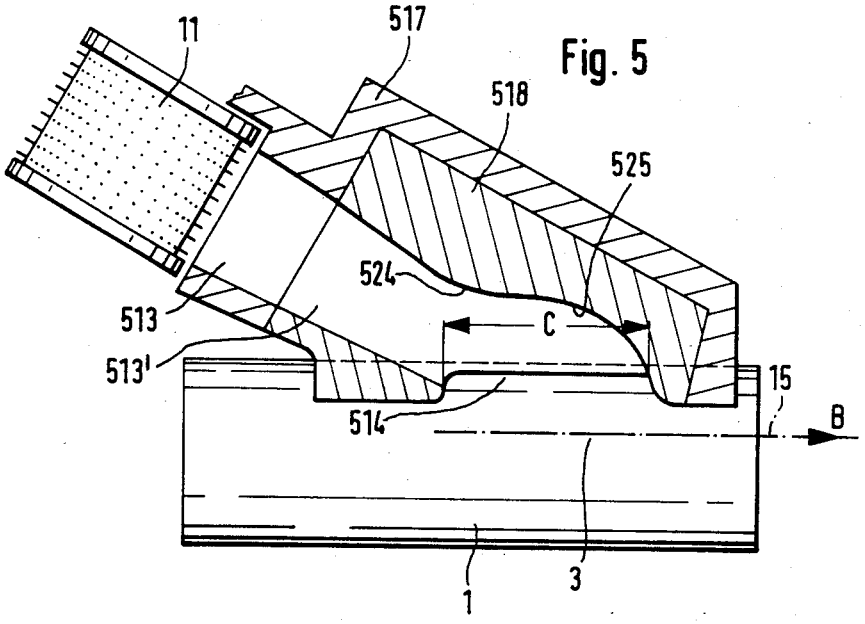
FIG. 5 is a schematic sectional view in about the plane of the wedge-shaped yarn forming gap showing another embodiment of the invention wherein the fiber feed channel is formed by the insert arranged within a fiber feed channel housing.

With the embodiment according to FIG. 5 a fiber channel housing 517 is provided into which the first portion 513 of a fiber feed channel is connected, starting at the circumference of an opening roller 11. The axle of the opening roller 11 extends parallel to the plane of the wedge-shaped gap while the fiber feed channel formed by the section 513 and a second section 513' contained in an insert 518, extends approximately in the plane of the wedge-shaped gap. The channel housing 517 includes a recess into which the insert 518 is fitted containing the section 513' of the channel which includes the fiber feed opening or mouth 514 and which thereby determines the distribution zone. The channel wall of insert 518 opposite the wedge shaped gap 3 is provided with a convex curvature 524 which results in a narrowing of the channel cross-section to which is then connected a concave widening 525 extending into the opening or mouth 514. This form of the channel makes it possible to straighten the fibers arriving with their ends first in the wedge-shaped gap 3 at the roller surfaces, due to the so-called whiplash effect in the area of the convexity formed by the concave ending 525. Therefore, it is not only possible with the emodiment according to FIG. 5 to predetermine the length of the fiber distribution zone in longitudinal direction of the wedge-shaped gap 3 by exchanging the insert 518, but furthermore to change the section 513' of the channel positioned in front of the opening or mouth 514 with respect to its cross-sectional shape. It is preferably provided that this part or section 513' connects steplessly to the portion 513 of the channel housing 517.

Figure 6:
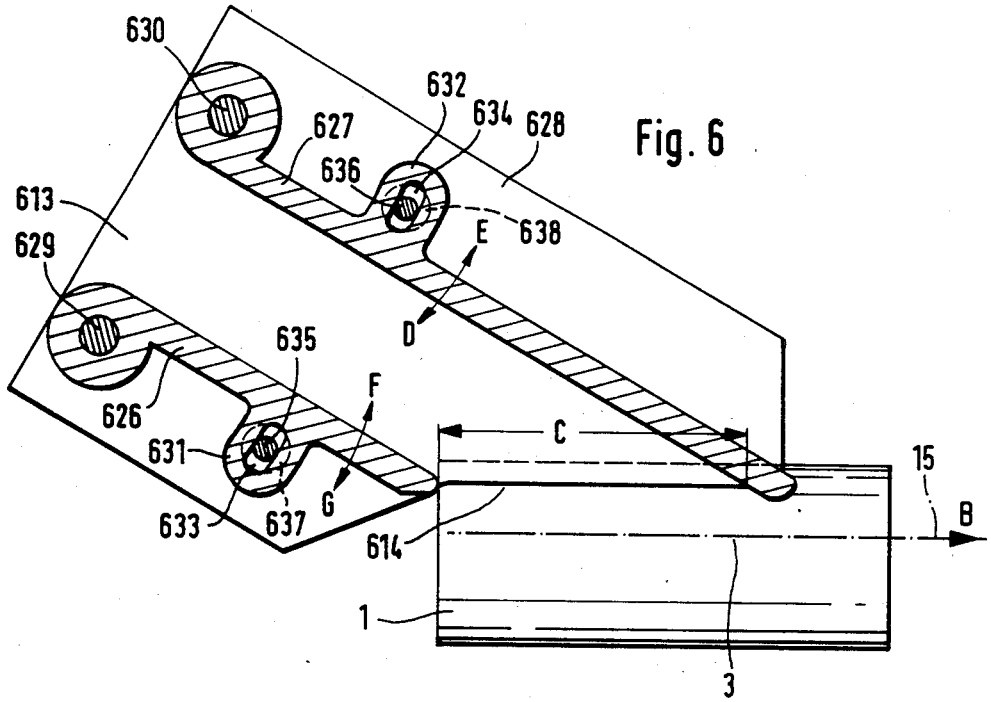
FIG. 6 is a schematic view in about the plane of the wedge-shaped yarn forming gap showing another embodiment of the invention with two adjustable channel walls restricting the fiber feed channel in the direction of the wedge-shaped gap.

With the embodiment according to FIG. 6, the two channel walls restricting the fiber feed channel 613 in the longitudinal direction of the wedge-shaped gap 3 are formed by means of pivotable plates 626 and 627 which are respectively fixedly hingedly attached to a channel plate 628 at a distance from the opening 614 about axles 629 and 630. The plates 626 and 627 are provided with adjustment latches 631 and 632 which include respectively a long hole 633 or 634 concentrically arranged with respect to the axles 629 and 630. In said holes 633 or 634 guide bolts 635 and 636 are provided. The respectively predetermined position is held by means of stationary set screws 637 and 638. The fiber feed channel 630 is formed as a closed channel by means of cover plates extending parallel to the channel plate 628.

In order to change the length of the fiber distribution zone, either one or both plates 626 or 627 are adjusted. It is thereby possible to adjust the plates 626 and 627 in such a manner that a constant channel cross-section remains, or one could also obtain a widening or narrowing channel cross-section. It is therewith possible not only to change the length of the distribution zone, but also to influence the airstream speed in the channel, and thereby the fiber speed.

With an embodiment according to FIG. 6 it is also possible to change the dispersion zone during operation of the open-end spinning device, for example during the start-spinning or yarn-piecing process. It is thereby possible to enlarge the distribution zone C for the yarn piecing process in order to ease the yarn piecing, and subsequently to return the plates 626 and 627 to their usual operational position. The possible motions of plates 626 and 627 are depicted by means of arrows D and E, as well as F and G.

Figure 7:
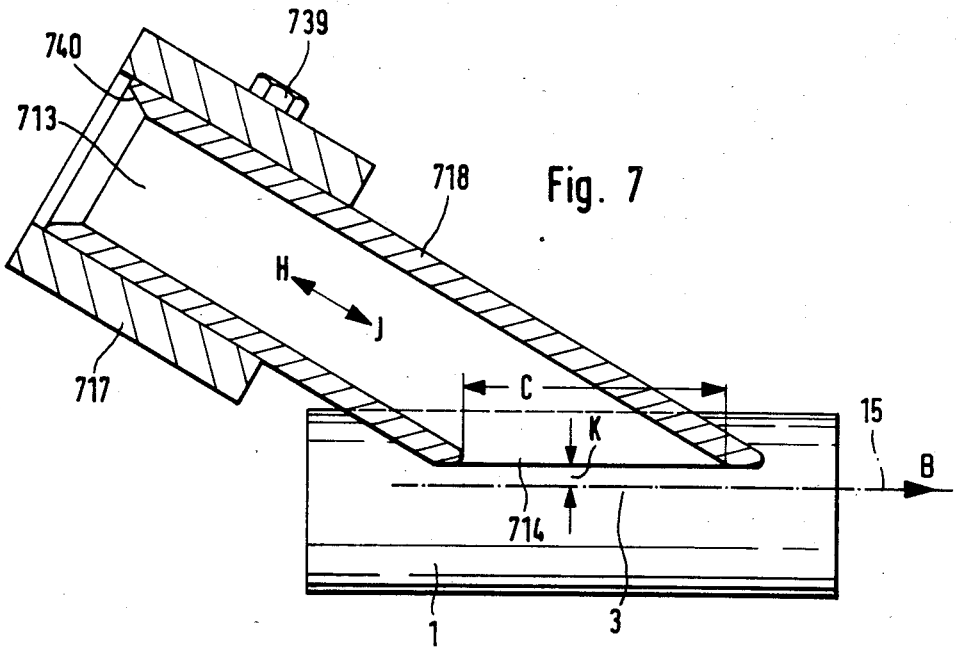
FIG. 7 is a schematic sectional view in about the plane of the wedge-shaped gap through another embodiment of the invention with a partial fiber feed channel element adjustable in the channel longitudinal direction.

With the emodiment according to FIG. 7, a fiber feed channel 713 is contemplated which extends essentially in the plane of the wedge-shaped gap 3 and is inclined about 45 degrees with respect to the longitudinal direction of wedge-shaped gap 3. Channel 713 is formed by a pipe-like insert 718 which is circumferentially closed and exhibits a flat, square cross-section. The insert 718 is provided with a fiber feed opening 740 and is connected to the channel housing 717 via the opening roller which is not further illustrated here. Compare FIG. 2 and 5 for a corresponding showing of an opening roller. Insert 718 is adjustable in its axial direction, in the direction of arrows H and J and is selectively fixedly attachable in the chosen position by means of screw means 739. By adjusting the insert 718 in its longitudinal direction, the position of the distribution zone C relative to rollers 1 and 2 and the wedge-shaped gap 3 formed by the essentially constant fiber feed opening or mouth 714 is changed, which means an enlarged or shortened treatment zone for the yarn 15 following the distribution zone can be obtained. Furthermore the distance K of the fiber feed mouth or opening 714, with respect to the wedge-shaped gap 3 is adjusted. An enlargement of this distance K leads to a heavier and thicker yarn.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open-end friction spinning of yarn having predetermined characteristics from fibers having a fiber length comprising: rotational direction to effect spinning of yarn in the yarn forming gap friction surface means defining a yarn formation zone, suction device means for effecting air flow at least in the area of the yarn formation zone, fiber feed means including a fiber feed channel means having a fiber feed opening facing the yarn formation zone and defining a fiber distribution zone in said yarn formation zone, yarn withdrawal device means for withdrawing spun yarn from the yarn formation zone, and adjusting means for selectively varying at least one of the size of the fiber feed opening and the relative position of the fiber feed opening to the yarn formation zone when at least one of the fiber length being processed and the predetermined desired yarn characteristics are varied.

2. Apparatus according to claim 1, wherein adjustable distribution zone means are provided for adjusting at least one of the relative positions of the distribution zone with respect to the friction surface means and the size of the distribution zone.

3. Apparatus according to claim 2, wherein at least one portion of the fiber feed channel means is constructed as an independent interchangeable component part.

4. Apparatus according to claim 1, wherein at least one portion of the fiber feed channel means is constructed as an independent interchangeable component part.

5. Apparatus according to claim 1, wherein the fiber feed channel means is provided with a feed channel housing means for accommodating a feed channel insert means which contains at least one channel wall which extends up to the fiber feed opening.

6. Apparatus according to claim 1, wherein at least a portion of the fiber feed channel means containing the fiber feed opening is restricted in the longitudinal direction of the yarn formation zone by means of an adjustably attached channel wall.

7. Apparatus according to claim 1, wherein said fiber feed channel means includes a feed channel insert means and detachable holding means for holding said feed channel insert means in selected adjusted positions, said feed channel insert means including said fiber feed opening.

8. Apparatus according to claim 7, wherein said feed channel insert means defines three channel walls of said fiber feed channel means.

9. Apparatus according to claim 7, wherein said channel insert means defines a two channel fiber feed path.

10. Apparatus according to claim 7, wherein said channel insert means defines a partially curved channel wall of the fiber feed channel means so as to form a fiber flow path which aids in properly aligning fibers as they are supplied to the distribution zone.

11. Apparatus according to claim 1, wherein said feed channel insert means defines a channel wall of said fiber feed channel means which is disposed closest to the end of the distribution zone at the yarn withdrawal side of the distribution zone.

12. Apparatus according to claim 1, wherein said fiber feed channel means is formed by at least one pivotal adjustable channel wall.

13. Apparatus according to claim 12, wherein said fiber feed channel means is formed by two facing pivotal adjustable channel walls.

14. Apparatus according to claim 1, wherein said fiber feed channel means includes a tubular member which is telescopically adjustably mounted at a holding means.

15. Apparatus according to claim 1, wherein the drivable friction surface means comprises a pair of adjacently arranged friction rollers drivable in the same direction, and the yarn formation zone comprises a wedge-shaped gap between the rollers.

16. Apparatus according to claim 15, wherein the fiber feed channel means is arranged essentially in the wedge-shaped gap plane extending perpendicular to the plane through the friction roller axes, said fiber feed channel means extending at an acute angle to the wedge-shaped gap and being provided with a section adjustable in its longitudinal direction, which section contains the fiber feed opening.

17. Apparatus according to claim 15, wherein the friction rollers are borne in such a manner that their relative position with respect to the fiber feed channel means is adjustable.

* * * * *